United States Patent [19]

Lister et al.

[11] 4,047,362

[45] Sept. 13, 1977

[54] PACKAGING MACHINE FOR INSERTING ARTICLES INTO BAGS

[75] Inventors: Edward Alan Lister, Burnley; Graham Wilson Clarke, Nelson, both of England

[73] Assignee: Brdr. Schur International A. S., Horsens, Denmark

[21] Appl. No.: 667,944

[22] Filed: Mar. 18, 1976

[30] Foreign Application Priority Data

Mar. 20, 1975 United Kingdom ..... 11594/75

[51] Int. Cl.[2] ..... B65B 43/36

[52] U.S. Cl. ..... 53/189; 53/258; 53/385

[58] Field of Search ..... 53/189, 385

[56] References Cited

U.S. PATENT DOCUMENTS

| | | | |
|---|---|---|---|
| 3,508,379 | 4/1970 | Noyes et al. | 53/189 |
| 3,556,316 | 1/1971 | Marasso | 53/189 X |
| 3,903,675 | 9/1975 | Plumb | 53/189 |
| 3,930,352 | 1/1976 | Carnes | 53/189 |

*Primary Examiner*—Travis S. McGehee

[57] ABSTRACT

A packaging machine for inserting semi-compressible articles into preformed bags comprises an upper gripping member, a lower gripping member which can be raised towards the upper gripping member to clamp therebetween extension portions of a stack of bags, the lower gripping member mounting means for temporarily retaining the bags of the stack of bags relative to the lower gripping member and means for inserting articles through the open end of the upper bag. The arrangement is such that the gripping members grip the extensions of the bags so that articles can be inserted into the upper bag, the articles undergoing limited compression against the end wall of the bag after which the clamping pressure is released. The filled bag then moves relative to the lower gripping member, the force applied to the bag being sufficient to overcome the restraint imposed by the temporary retaining means.

20 Claims, 7 Drawing Figures

PACKAGING MACHINE FOR INSERTING ARTICLES INTO BAGS

This invention relates to packaging machines of the kind intended to insert semi-compressible articles into preformed bags, the bags being of the kind having one side thereof extended at the open end of the bag so as to define an extension portion.

The object of the invention is to provide such a machine in a simple and convenient form capable of achieving a tightly packed bag.

According to the invention a packaging machine of the kind specified comprises an upper gripping member, a lower gripping member which can be raised towards the upper gripping member to clamp therebetween said extension portions of a stack of bags, means carried by the lower gripping member for temporarily retaining the bags of the stack of bags relative thereto, and means for inserting articles through the open end of the upper bag, the arrangement being such that said gripping members are arranged to grip the extensions whilst articles are inserted into the upper bag, said articles undergoing limited compression against the end wall of the bag after which the clamping pressure is released, the filled bag then moving relative to the lower gripping member, the force applied to the bag being sufficient to overcome the restraint imposed by the temporary retaining means.

According to a further feature of the invention, said temporary retaining means comprises at least a pair of spaced pins carried by the lower gripping member.

One example of a packaging machine in accordance with the invention will now be described with reference to the accompanying drawings in which.

Figure 1:
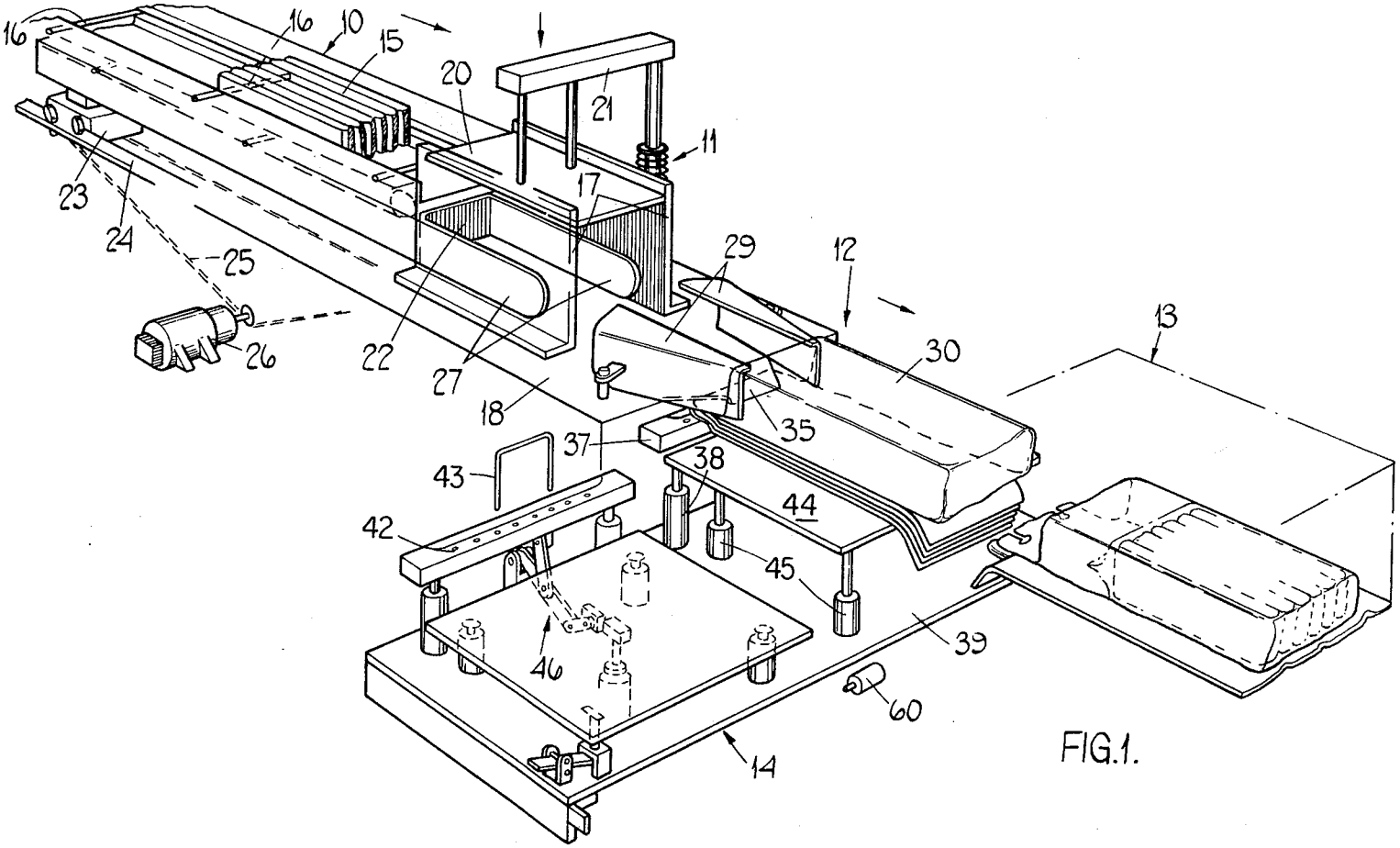
FIG. 1 is a perspective view of the machine.

With reference to FIG. 1 of the drawings the machine comprises a conveyor section 10, a lift section 11, a loading section 12 and a bag sealing section 13. Moreover associated with the loading section is a bag storage section 14.

The conveyor section 10 serves only to transport a group of towels 15 from a production machine (not showm) to the lift section 11 and its construction forms no part of the present invention. Briefly however the conveyor section comprises a pair of spaced endless chains between which extend bars 16, the bars being spaced in the direction of movement of the conveyor, The gap between following bars serves to accommodate a group of towels and at the end of the run of the conveyor the group of towels is passed between a pair of side plates 17 which form part of the assembly section.

The side plates 17 are mounted on a base plate 18 which is itself carried by on a supporting structure 19. Also forming part of the lift section is a vertically movable ram 20 which is movable between the plates 17. The ram is powered by a piston cylinder combination disposed on the outer side of one of the plates 17 and is connected by an overhead beam 21 which is attached to the ram by a pair of depending rods. In FIG. 1 the ram 20 is shown in the raised position waiting for a group of towels to be fed between the plates 17. Positioned below the conveyor section is a movable ram 22. The ram is mounted on a trolley 23 which is carried on a track 24. A chain 25 is coupled to the trolley 23 and is driven by a motor 26 to effect longitudinal movement of the ram.

Figure 2:
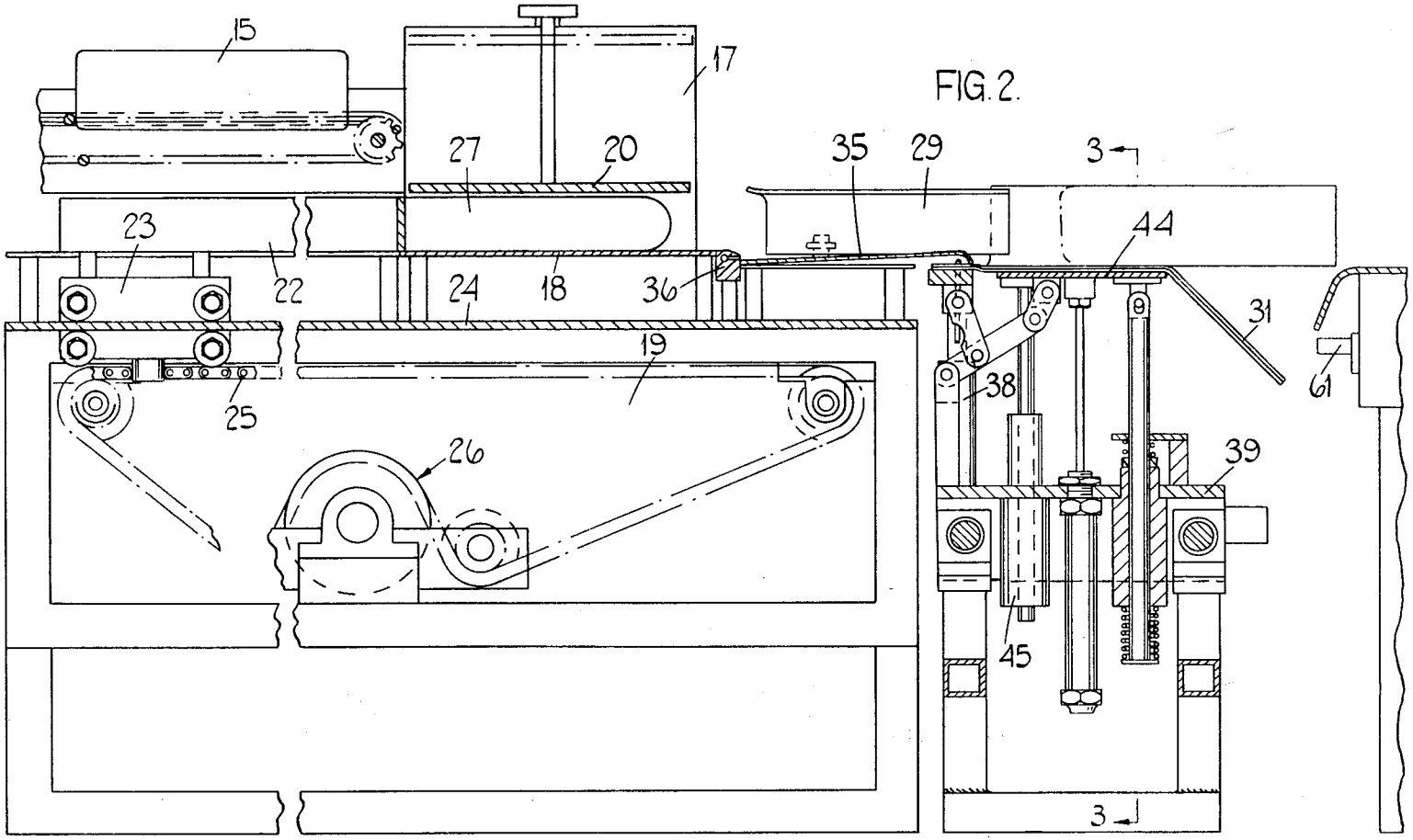
FIG. 2 is a side elevation of part of the machine seen in FIG. 1.

In the retracted position of the ram 22 as shown in both FIGS. 1 and 2, the leading edge of the ram is clear of the vertically movable ram 20. The leading face of the ram carries a pair of spaced and flexible support plates 27 which lie in close proximity to the inner faces of the side plates 17. Conveniently the support plates are interconnected by an integral bridge member which is secured to the ram 22. As the ram 20 is moved to the lowered position in which it is seen in FIG. 2, a group of towels is pushed downwardly to between the supporting plates 27.

Forming part of the loader section 12 is a pair of hinged deflector plates 29. These plates are mounted about vertical pivots on the base plate 18. The plates are of angle section and the ends thereof remote from the lift section extend into the open end of a bag 30. When the ram 22 is moved to its advanced position the group of towels held between the plates 27 is moved between the deflector plates 29 into the open bag. The movement of the ram 22 continues and the towels reach the closed end of the bag. Further movement of the ram takes place but this portion of its movement will be described later. Whilst the ram 22 is moving as described the vertically movable ram 20 is raised to receive a new group of towels.

Figure 7:
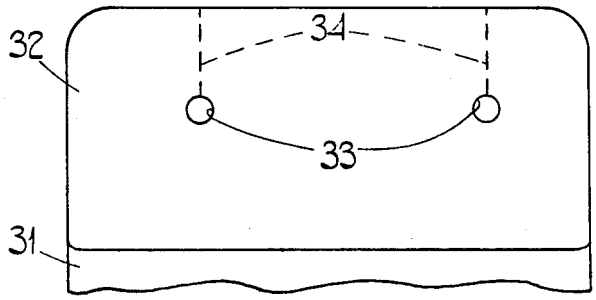

The important section of the machine so far as the present invention is concerned is the part of the loading section 12 which supports the bags 30. The bags in the particular example are formed from heat sealable plastics material and the heat sealing is carried out in the sealing section 13, the sealing section comprising a conventional heat sealing unit. The bags are constructed in known manner with a bag portion 31 as seen in FIG. 7, one side of the bag portion being extended at the open end to form an extension 32. Furthermore, the extension is provided with a pair of spaced apertures 33 and lines of weakness 34 are provided between the apertures 33 and the adjacent common edge of the extension, the lines of weakness being defined by perforations.

Figure 5:
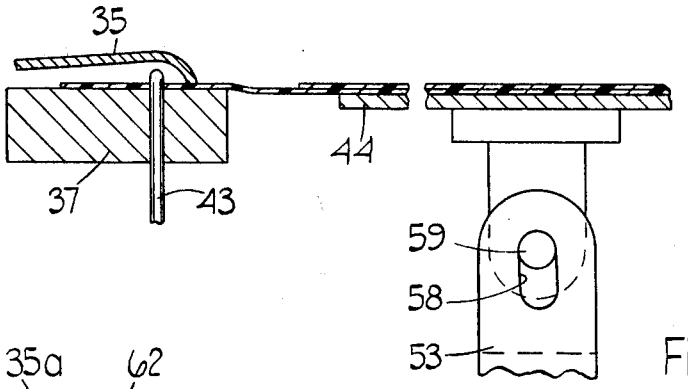
FIG. 5 and 6 show a portion of the apparatus seen in FIG. 3 to an enlarged scale and at differing settings and FIG. 7 shows a plan view of the end of a bag in which articles are inserted by the machine.
Figure 6:
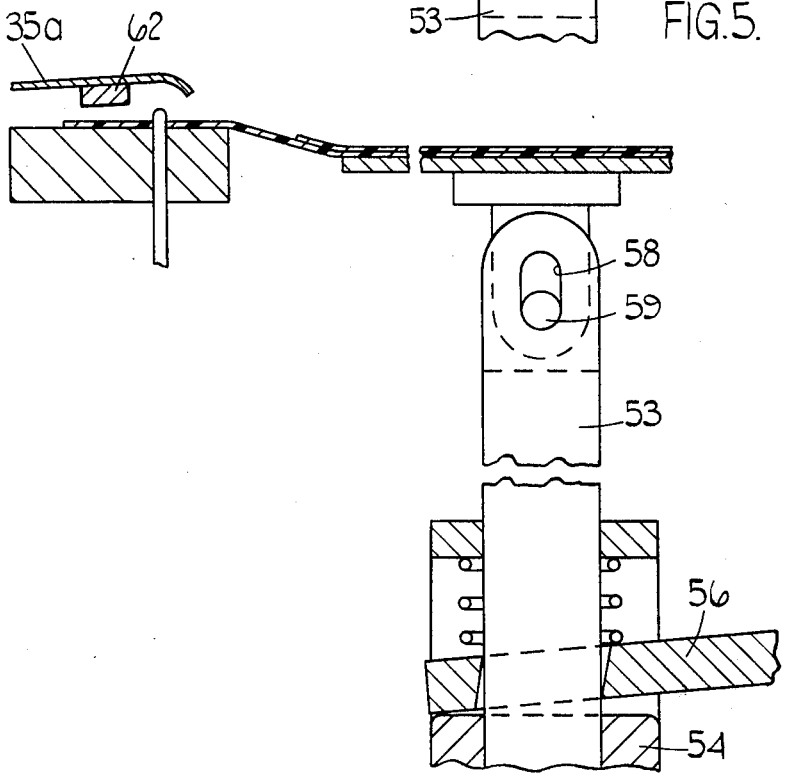

For holding the bags during the initial part of the filling operation as described above there is provided a fixed upper gripping member 35 which extends laterally of the direction of movement of the ram 22. The gripping member also extends in the direction of movement of the towels and its trailing end is curved downwardly as shown in FIGS. 5 and 6 to form a gripping edge. The member at its leading edge is attached to a fixed part of the machine, the leading edge being disposed slightly below the base plate 18 as best seen in FIG. 2. Disposed between the base plate 18 and the upper gripping member is a block 36 which is bored to define an air passage having outlet jets facing in the direction of the bags.

Also provided is a lower gripping member 37 which as seen in FIGS. 2, 5 and 6 is positioned below the gripping member 35. Moreover, the lower gripping member extends in the direction of the path of movement of the towels so as to provide support for the aforesaid extensions 32 of the bags. The lower gripping member 37 is mounted for vertical movement on a pair of slides 38 which are themselves mounted on a base plate 39 which is itself laterally movable. For the latter purpose the plate 39 is connected to a pair of parallel bars 40 carried in bearings 41 fixed to a supporting structure.

Figure 3:
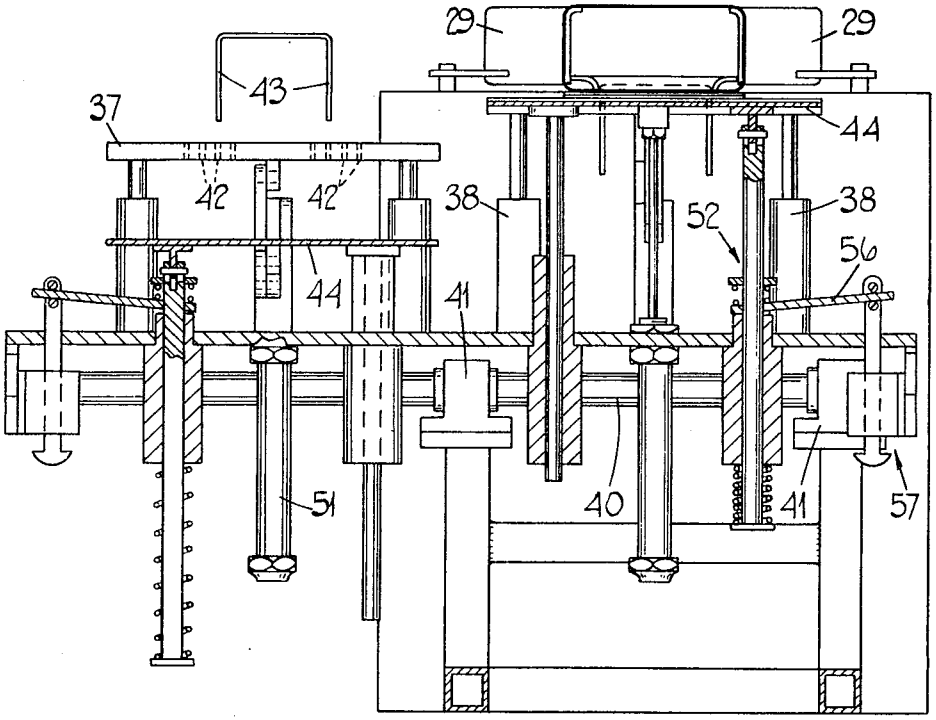
FIG. 3 is a sectional end elevation on the line 33 of FIG. 1.

The lower gripping member is provided with a plurality of apertures 42 best seen in FIG. 3 and in which can be located a pair of pegs 43 which pass through the apertures 33 in the extensions of the bags. As shown in FIG. 3 the pegs are interconnected and as seen in FIG. 5 in the raised position of the lower gripping member the portion connecting the peg lies beneath the downwardly curved portion of the upper gripping member.

The bag portions of the bags are supported by a support plate 44 and this is mounted for vertical movement on the plate 39 by means of slides 45. Moreover, the lower gripping member 37 can be raised to ensure that the extensions 32 of the bags forming the stack of bags are firmly gripped between the gripping members.

The lower gripping member 37 and the support plate 44 are coupled by means of a lever system 46 which ensures that the plate 44 moves upwardly at a higher rate than the gripping member. This compensates for the fact that whereas each bag contributes a single thickness as far as the gripping members are concerned, it has at least two thicknesses on the support plate. The lever system comprises a first link 47 which at one end is pivotally connected to a fixed support 48 upstanding from the plate 39. This link is pivotally connected at a position removed from the pivot, to a short link 49 connected to the lower gripping member. At its other end the main link 47 is pivotally connected to one end of a drop link 50 the other end of which is pivotally connected to the support plate 44. For raising the plate 44 and thereby through the lever system 46, the lower gripping member 37, a piston cylinder combination 51 is provided.

The arrangement of the lever system is such that when the plate is positioned to receive a fresh supply of bags as seen on the left of FIG. 3, the plate is appreciably lower than the lower gripping member, the difference in the two levels decreasing as the bags are used.

During the sequence of operation of the machine it is necessary to release the clamping pressure imposed by the gripping members 35, 37. This is achieved by releasing the air under pressure from the piston cylinder and combination 51. When this is done the lower gripping member 37 and the support plate 44 fall under the action of gravity. It is desirable however that the extent of fall should not be much more than is required to release the clamping pressure. This desirable feature is achieved using a self-adjusting stop.

Figure 4:
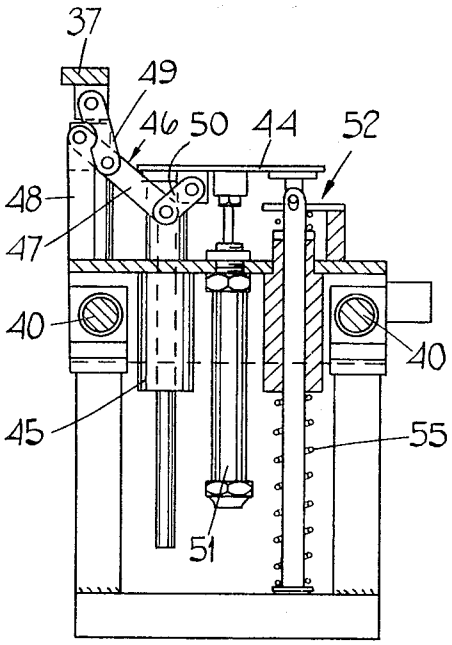
FIG. 4 is a view of part of the machine seen in FIG. 2 with the parts in a different position.

The self adjusting stop is indicated at 52 in FIGS. 3 and 4, but its operation is best understood from FIGS. 5 and 6. The stop comprises a rod 53 slidable within a housing 54 carried by the plate 39. The rod is spring loaded in the downwards direction by means of a coiled compression spring 55 (FIG. 4). The downward movement of the rod under the action of its spring is prevented by means of a sprag arm 56 through an oblique aperture in which the rod extends. The sprag arm 56 is urged to the binding position by means of a coiled compression spring 57 and it can be moved from the binding position in which the aperture becomes aligned with rod, by means of a solenoid 57 having an armature connected to the arm.

At its upper end the rod is provided with an elongated slot 58 in which is located a pin 59 mounted on the plate 44. When air under pressure is supplied to the piston cylinder combination 51 the pin 59 is moved to the upper end of the slot and if required upward movement of the rod 53 will take place because the sprag arm does not prevent upward movement of the rod. When the air pressure is released the plate 44 will move downwardly under the action of gravity but the extent of downward movement is limited by the abutment of the pin with the lower end of the slot. Hence although the gripping pressure is released the downward movement of the gripping member 37 and support plate 44 is limited. When a fresh supply of bags is required then the solenoid 57 is energized to allow the full downward movement of the gripping member 37 and support plate 44.

The operation of the machine has been described to the point where the group of towels has just reached the closed end of the bag. The ram 22 continues its movement and during the initial portion of the movement the towels are compressed within the bag, the bag being firmly held against movement. The clamping pressure is then removed by lowering the support plate and lower gripping member and the bag starts to move with the ram during which time the aforesaid pegs 43 tear through the weakened portions 34 of the extension 32. The bag is then free to move with the ram which moves the bag into the bag sealing section 13. The movement of the bag continues until it encounters a stop and further slight movement of the ram effects further slight compression of the towels. Moreover the bag is gripped and the ram retracted. Following retraction of the ram the open end of the bag is quickly closed by a conventional heat sealing process before any substantial expansion of the towels has taken place. The closed bag is then discharged and the process repeated.

When the ram has been fully retracted the extensions of the bags are again gripped and the aforesaid jets of air open up the upper bag so that its open end engages about the ends of the deflection plates 29.

The resultant product is a lightly filled bag of towels a substantial contribution to the tightness of the packing being provided by the fact that the towels are compressed within the bag before the bag is removed from the stack.

The pegs 43 are only provided for the purpose of retaining the bags in stack form when the clamping pressure is removed. Other forms of retaining means could be provided to achieve this object.

FIG. 3 demonstrates that whilst the machine is using bags from one stack a fresh stack of bags can be loaded onto the machine and brought into use when the one stack of bags is exhausted. The change over may be achieved automatically using a double acting piston cylinder combination acting between the supporting structure 42 and the plate 39. Switches 60 only one of which is shown, are operated at the extreme positions of the plate 39 respectively to determine the movement of the plate when a sensor 61 detects the use of the last bag of the stack of bags being currently used. Means is of course provided to ensure that the plate 39 is not moved until the last bag has been filled.

As described the gripping member 35 extends to define a gripping edge which engages the bags on the side of the pins 43 remote from the ram. As shown in FIG. 6 the bags can be gripped on the other side of the pins. In this case the gripping member is constituted by a bar 62 which is positioned beneath the member 35*a* which acts as a deflector plate to guide the towels over the gripped ends of the bags.

We claim:

1. A packaging machine for inserting semi-compressible articles into preformed bags of the kind having one side thereof extended at the open end of the bag so as to define a main portion and an extension portion, the machine comprising a plate for supporting a stack of said bags substantially beneath their main portions, a stationary upper gripping member for engaging the upper surfaces of said extension portion of said bags, a movable lower gripping member supporting the extension portions of said bags in opposition to said upper gripping member, means carried by the lower gripping member for temporarily retaining the bags of the stack of bags relative thereto; means for inserting articles through the open end of the upper bag of the stack; and, linkage means connecting said lower gripping member and said support plate for effecting differential vertical movement therebetween; means for raising said lower gripping member upwardly toward said upper gripping member to clamp said extension portions therebetween; and means for permitting said lower gripper member to release the extension portions, said gripping members being maintained in clamping pressure about said bag extension portions while the articles are inserted into the upper bag, said articles undergoing limited compression against the end wall of the bag after which the clamping pressure is released by movement of said lower gripping member, permitting the filled bag to move relative to the upper and lower gripping members under the influence of said article inserting means, the force applied to the bag being sufficient to overcome the restraint imposed by the temporary retaining means.

2. A machine according to claim 1, wherein said means operable to raise the lower gripping member comprises a first powered device operable to raise said support plate said linkage means interconnecting the support plate and the lower gripping member whereby upward movement of the support plate will result in upward movement of the lower gripping member.

3. A machine according to claim 2 in which said linkage means is arranged so that the lower gripping member moves at a lower rate than the support plate.

4. A machine according to claim 3 in which said first powered device comprises a fluid pressure operable piston cylinder combination.

5. A machine according to claim 2 in which said lower gripping member and said support plate are mounted for vertical movement on a base plate.

6. A machine according to claim 5 in which said upper gripping member comprises a plate like member extending in the direction of movement of the articles, the leading end of the member being curved downwardly to define a gripping edge.

7. A machine according to claim 6 in which the upper surface of the upper gripping member forms a guide surface for the articles as they are pushed into the bag.

8. A machine according to claim 7 in which said temporary retaining means comprises a pin which passes through an aperture in the extension portion of the bag, said pin being located in an aperture in the lower gripping member.

9. A machine according to claim 8 in which a pair of pins are provided, the upper ends of said pins being interconnected by a bridge piece which when the lower gripping member is in the raised position lies beneath the trailing end portion of the upper gripping member.

10. A machine according to claim 6 including a self-adjusting stop operable to limit the downward movement of the support plate and lower gripping member when the powered device is de-energized to release the clamping pressure.

11. A machine according to claim 10 in which the self-adjusting stop comprises a member movable upwardly as bags are used from a stack of bags carried by the support, the stop means for preventing downward movement of said member and a lost motion connection intermediate said member and the support plate whereby the support plate can move downwardly a limited extent when said powered device is de-energized.

12. A machine according to claim 11 in which said lost motion connection comprises a pin and slot connection.

13. A machine according to claim 11 in which said stop means includes a sprag arm which is resiliently biased into engagement with said member to prevent downward movement thereof, said sprag arm allowing upward movement of the member, said stop means including means for moving the sprag arm from its binding position to allow downward movement of the support plate when it is required to replace the stack of bag.

14. A machine according to claim 7 in which the means for inserting the articles comprises a longitudinally movable ram, said ram having at its leading end a pair of spaced supporting plates between which the articles to be inserted into the upper bag are placed, prior to movement of the ram in the direction towards the open end of the bag.

15. A machine according to claim 14 including a pair of hinged deflector plates between which the articles pass during their movement by the ram, the leading ends of said deflector plates extending into the open end of the upper bag to ensure that the bag is maintained in the fully open condition during the insertion of the articles.

16. A machine according to claim 15 in which said deflector plates are of angle form with the base portions of the deflector plates being substantially vertically disposed, said deflector plates being hinged adjacent their leading ends about substantially vertical axes.

17. A machine according to claim 15, including an air jet disposed at the leading end of the guide surface defined by the upper gripping member, said air jet being operable when the ram is in the retracted position, to inflate the upper bag of the stack to ensure that the trailing ends of the deflector plates are located within the open end of the bag.

18. A machine according to claim 16, in which two lower gripping members and two support plates are provided together with the associated components, said gripping members and support plates being mounted on a laterally movable support whereby one of the lower gripping members and its associated support plate can be loaded with a fresh supply of bags whilst the other gripping member and associated support plate are in use.

19. A packaging machine for inserting semi-compressible articles into preformed bags of the king having one side thereof extended at the open end of the bag so as to define an extension portion, the machine comprising a stationary upper gripping member in the form of a bar extending laterally of the direction of movement of the articles; a deflector plate extending over said bar; a base plate; a lower gripping member mounted on said base plate for vertical movement towards said upper gripping member to clamp therebetween said extension portions of a stack of bags; a support plate for supporting the bag portions of the stack of bags mounted on said base plate for vertical movement; a powered device for raising and lower gripping member operable on said support plate; a lever system interconnecting said support plate and lower gripping member whereby upward movement of said support plate results in upward movement of said lower gripping member; means carried by said lower gripping member for temporarily retaining the bags of the stack of bags relative thereto; and means for inserting articles through the open end of the upper bag; the arrangement being such that said gripping members are arranged to grip the extensions while articles are inserted into the upper bag, said articles undergoing limited compression against the end wall of the bag after which the clamping pressure is released, the filled bag then moving relative to the lower gripping member, the force applied to the bag being sufficient to overcome the restraint imposed by the temporary retaining means.

20. A machine according to claim 19, wherein said bar is positioned in front of said means for temporarily retaining said bags.

* * * * *